US005941772A

United States Patent [19]

Paige

[11] Patent Number: 5,941,772

[45] Date of Patent: Aug. 24, 1999

[54] APPARATUS AND METHOD FOR ENHANCING GAMBLING DEVICES WITH COMMERCIAL ADVERTISING INDICIA

[76] Inventor: Elena Launzel Paige, 902 Glen Cove Ave., Glen Head, N.Y. 11545

[21] Appl. No.: 08/755,890

[22] Filed: Dec. 2, 1996

[51] Int. Cl.[6] ..... G07F 17/34

[52] U.S. Cl. ..... 463/20; 463/25; 273/143 R

[58] Field of Search ..... 463/20, 12, 13, 463/25; 364/412, 410; 273/143 R, 138.1, 138.2, 139

[56] References Cited

U.S. PATENT DOCUMENTS

| | | | |
|---|---|---|---|
| 4,953,895 | 9/1990 | Goussios | 283/102 |
| 5,179,517 | 1/1993 | Sarbin et al. | 364/410 |
| 5,555,991 | 9/1996 | Hart | 211/73 |
| 5,573,501 | 11/1996 | Ruscito et al. | 602/7 |

OTHER PUBLICATIONS

Affidavit of Jessica Harrison, Dec. 1994.

Gasser Chair Company, Inc. advertisement, IGWB, vol. 17, No. 3, p. 53, Mar. 1996.

Software 2000 advertisement, IGWB, vol. 17, No. 8, p. 41, Aug. 1996.

132 Declaration of Edward Launzel dated Dec. 31, 1997 directed to unauthorized limited temporary display of images of a manufactured product in Oct. 1995, which was withdrawn upon discovery at the demand of Harley Davison Corporation. The aforesaid display was not a commercially sustainable advertising display because its withdrawal was instantly demanded when Harley Davison discovered it.

Pollack, Judann, "Start–up Seeks To Put Brand Logos On Slots", *Advertising Age*, Jul. 21, 1997, one page newspaper article.

Kozlowski, Martin, "New Home For The Camel? Atlantic City Casinos Open A New Ad Medium–13 The Slot Machine", *Advertising Age*, Jul. 28, 1997, one page illustrated editorial cartoon.

Herriot, Stacy, "Power Products—Advertising Opportunity", *Casino Journal*, vol. 10, No. 10, Oct. 1997, one page magazine article, superimposed over magazine cover.

Wizard Co., Inc. "Book Avis And Hit The Jackpot", *Travel Weekly*, Apr. 28, 1997, page 3 advertisement.

Photograph of Pyramid Motor Co.—satirical, fictional motor company, Oct. 1997, one photograph showing car in conjunction with second photograph of "Red, White and Blue" slot machine having generic word "car" on reels at Luxor Casino, Las Vegas, Nevada.

Slot Machines by Marshall Fey, Liberty Bell Books, pp. 2, 3, 94, 95, 101, 106, 156, 157 and 188, 1994.

*Primary Examiner*—Benjamin H. Layno

[57] ABSTRACT

An apparatus and method are directed to exploiting the activity of slot machine wagering for commercial advertising purposes and/or for dispensing of advertising, commercial or promotional merchandise. In the apparatus the jackpot and/or pay off symbols are replaced with an advertiser's product identity or logo. While the casino payoffs remain unchanged, the players look for a match of product logos instead of the familiar "7-7-7" or bells or cherries. In this manner, the very act of winning is linked to the product being advertised. Additional incentives for the player as well as the casino are related to this advertising method. Commercial indicia are applied to slot machines. The method utilizes a system for tying use of the invention with accumulation of points redeemable for merchandise.

15 Claims, 3 Drawing Sheets

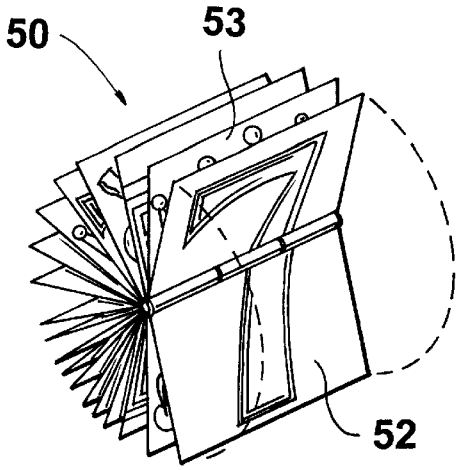
Fig. 2A
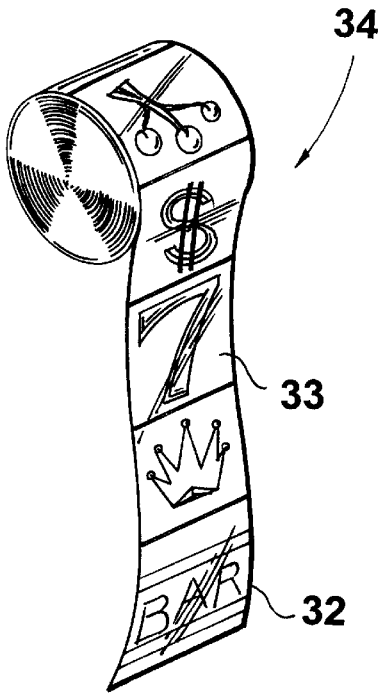
Fig. 2B
Fig. 2C
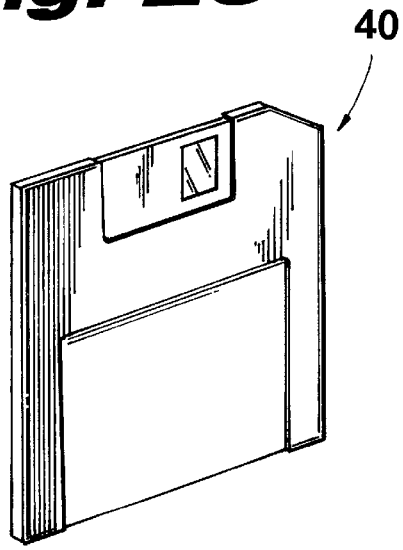
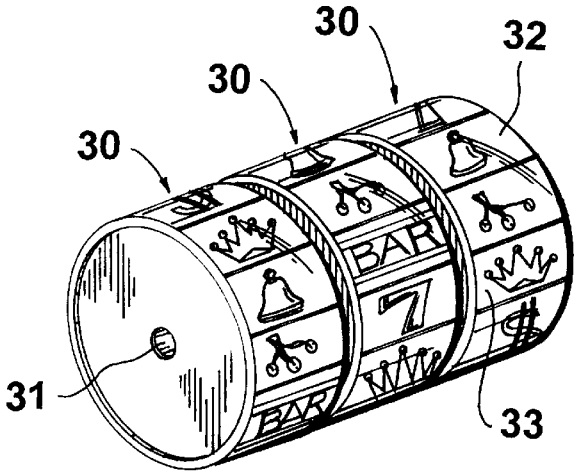
Fig. 2D

APPARATUS AND METHOD FOR ENHANCING GAMBLING DEVICES WITH COMMERCIAL ADVERTISING INDICIA

FIELD OF THE INVENTION

The present invention relates to an improved slot machine for casino gambling for improving the commercial communication of the machine in order to display advertising messages/commercial indicia and for dispensing advertising and/or promotional merchandise, or bonus merchandise points redeemable for advertising, commercial or promotional merchandise.

BACKGROUND OF THE INVENTION

In 1995, over 64 million visitors wagered 115 billion dollars in Atlantic City and Las Vegas. The players represent a captive mature audience over 21 years of age. Those who play the slot machines give these their undivided attention for long periods of time.

The art related to the present invention includes U.S. Pat. No. 4,953,895 of Goussios for a dual purpose lottery ticket and boarding pass. However, Goussios '895 describes a transportation validation ticket—i.e., a boarding pass—and is not a device having moving parts, is not a device with lights and sound-making means for attracting potential users, as is a slot machine, and is not used in a casino. In contrast, the present invention applies commercial indicia—i.e., advertising, to mechanical devices having moving parts, i.e., slot machines, in a location and a context, i.e., in a casino, in which it is the very object of the user to gamble and thus impulsively dispose of funds. Such is not the case for the Goussios '895 lottery ticket, which is to be used at airline boarding gates.

The purchasing psychology of a user is very different for the present invention—used in a casino—when compared with the purchasing psychology of a person who is handed an airline boarding pass.

Also to distinguish between Goussios and the present invention, Goussios does not utilize a system for tying use of the invention with accumulation of points redeemable for merchandise, as does the present invention.

Further, Goussios does not provide for the commercial indicia displayed on the Goussios invention to serve to attract the user to actually spend money—which the present invention addresses itself to.

Among additional related art is U.S. Pat. No. 5,555,991 of Hart for a product-supported advertising display and method wherein a packaged product is supported by a display member. U.S. Pat. No. 5,573,501 of Ruscito et al., describes a medical orthotic device which includes an indicia-bearing exterior surface layer for display of drawings, insignias or photographs. The purpose of Ruscito et al. '501 is to make children wearing orthotics more comfortable and familiar with their devices by displaying indicia which the children find pleasing.

The related art fails to disclose an apparatus and method directed to exploiting the activity of slot machine wagering for commercial advertising purposes and/or for dispensing of advertising, commercial or promotional merchandise.

OBJECTS OF THE INVENTION

An object of the present invention is to improve a slot machine for casino gambling so as to facilitate the commercial communication of the slot machine in order to display advertising messages/commercial indicia.

It is a further object of the present invention to provide a slot machine capable of dispensing advertising and/or promotional merchandise, or bonus merchandise points redeemable for advertising, commercial or promotional merchandise.

Another object of this invention is to use the various surfaces of slot machines for advertising.

Another object is to substitute product logos for the jackpot and/or pay off symbols of the slot machines.

Still another object is to offer a source of advertising income to the casino.

Another object is to offer players an incentive to use a casino card.

SUMMARY OF THE INVENTION

This invention deals with an apparatus and method directed to exploiting the activity of slot machine wagering for commercial advertising purposes and/or for dispensing of advertising, commercial or promotional merchandise.

Besides offering fascias as an advertising venue, the jackpot and/or pay off symbols themselves are replaced with an advertiser's product identity or logo. While the casino payoffs remain unchanged, the players look for a match of product logos instead of the familiar "7-7-7" or bells or cherries. In this manner, the very act of winning is linked to the product being advertised. Additional incentives for the player as well as the casino are related to this advertising method.

The present invention applies commercial indicia—i.e., advertising, to mechanical devices having moving parts, i.e., slot machines, in a location and a context, i.e., in a casino, in which it is the very object of the user to gamble and thus impulsively dispose of funds.

The present invention is a device having moving parts, with lights and sound-making means for attracting potential users, and is used in a casino. The present invention applies commercial indicia—i.e., advertising, to mechanical devices having moving parts, i.e., slot machines, in a location and a context, i.e., in a casino, in which it is the very object of the user to gamble and thus impulsively dispose of funds.

The purchasing psychology of a user is an important related aspect of the present invention because among the objects of the invention is to increase sales revenue of casinos and commercial advertisers. Gamblers go to casinos knowing that they intend to spend money, and commercially attracting gamblers with visual advertising stimuli is a tangible feature of the present invention, because gamblers are persons with a money-spending mind-set and since generating revenue for advertisers is a component of the present invention.

Furthermore, the present invention utilizes a system for tying use of the invention with accumulation of points redeemable for merchandise.

BRIEF DESCRIPTION OF THE DRAWINGS

The present invention can best be understood in conjunction with the accompanying drawings, in which:

FIG. 2 is a comparison of gaming media, wherein:

FIG. 2A is a perspective view of a card reel used with a slot machine;

FIG. 2B is a perspective view of an image strip on a circular reel used with the improved slot machine of the present invention as in FIG. 1;

FIG. 2C is a perspective view of a digital graphic data computer diskette used with another embodiment for an improved slot machine and method of dispensing merchandise associated therewith.

FIG. 2D is a perspective view of three circular slot machine reels used inside the improved slot machine as in FIGS. 1 and 2B; and, FIG. 3 is a flow chart of a method for using the improved slot machine of the present invention with tangible advertising promotional tie-in merchandise items.

DETAILED DESCRIPTION OF THE DRAWINGS

Figure 1:
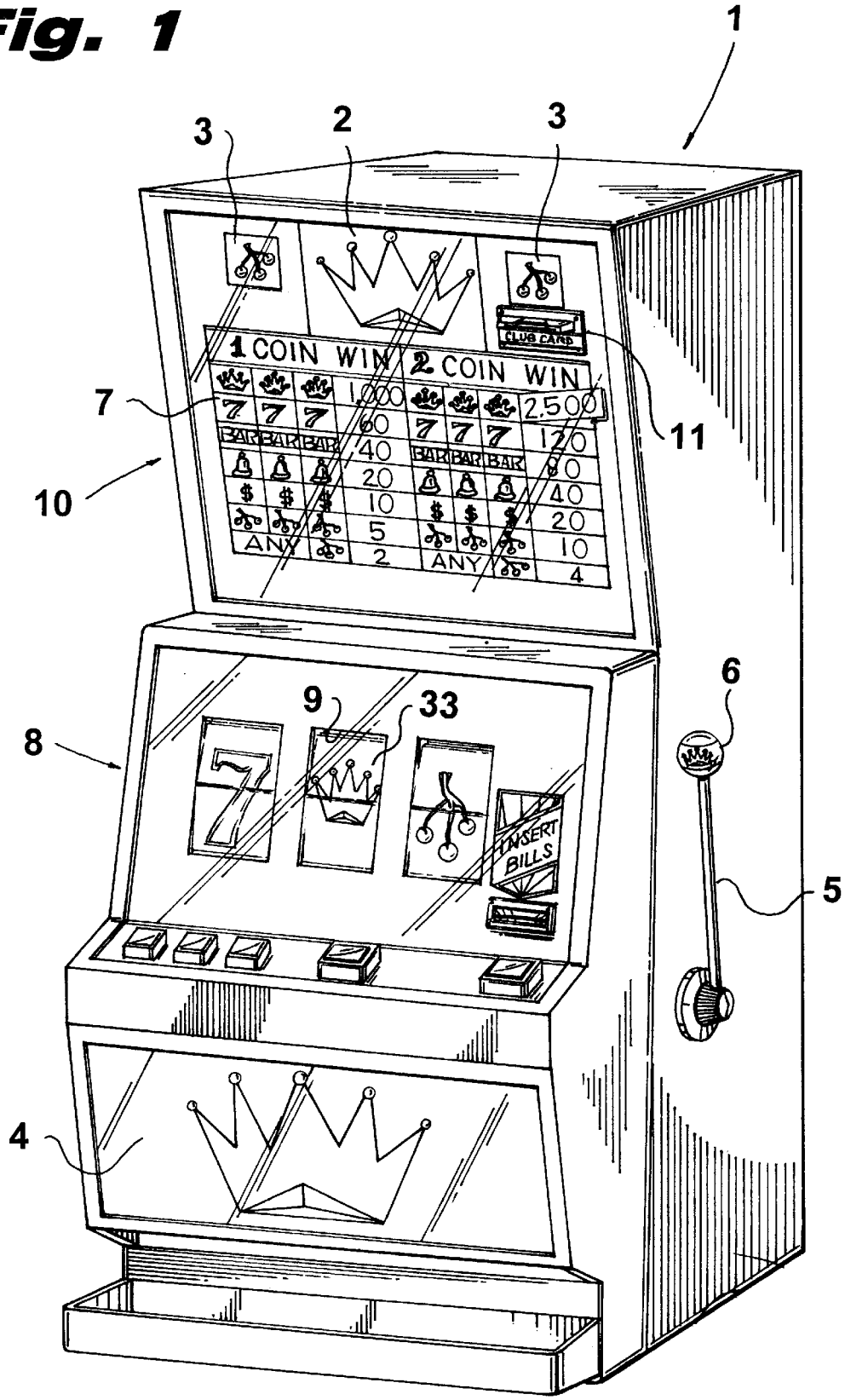
FIG. 1 is a perspective view of an improved free-standing slot machine, according to the present invention.

As shown in the drawing figures, FIG. 1 shows a free-standing slot machine 1. Table-top machines of the mechanical or electronic video variety may also be used. The top fascia 10 of the machine 1 has ample space for an advertising message or large logo 2. Small logos in the exact aspect ratio and image of the jackpot and/or pay off symbols 3 are also shown. The same symbols 7 simply depicted as "L" are shown in the "winnings table". Even the knob 6 on the pull handle 5 can be used as a logo site. Bottom fascia 4 offers a large advertising space. The central area 8 shows the actual gaming media prize window 9 displaying and illustrating the logo symbol 33 shown in FIG. 2B being substituted for one of the normal jackpot and/or pay off symbols 32 shown in FIG. 2B.

The club card slot 11 in the upper right corner of machine 1 is used by players who are casino members. The card slot 11 is used when a user card, which is machine-readable and encodable with user gambling information, is inserted therein.

Although, in the preferred embodiment, slot machine 1 includes graphic symbols 32 and 33, wherein symbols 33 are associated with a single advertiser, in an alternate embodiment of the present invention, advertising indicia from more than one advertiser may be installed on a slot machine 1 and/or in reel 34 with symbols 33 representing the commercial message of more than one advertiser. A slot machine 1 may have any combination of non-advertising gaming symbols 32 mixed with advertising symbols 33, and this includes a reel 34 which may have only advertising symbols 33 without any non-advertising symbols 32. In the case where only advertising symbols 33 are installed upon reel 34, the symbols 33 may represent at least one advertiser, and may be visually varied so that the symbols of one particular advertiser need not be unique upon a particular reel 34.

FIG. 2 illustrates three types of gaming media used by the various types of slot machines; others types may also be used For example, FIG. 2A shows a typical old-fashioned card reel which flips until it stops at a random position revealing the selected symbol on the face of two cards.

FIG. 2B shows another slot machine indicia reel covering strip 34 having a plurality of gambling traditional-style gambling symbols 32 and, as in the novelty of the present invention, interspersed with the symbols 32 are commercial advertising indicia symbols 33 on the same reel covering strip 34 for random gambling presentation.

The reel covering strip 34 of FIG. 2B is the now-widely-used configuration which is the preferred embodiment of the present invention, where the selection symbols 32 and 33 are printed in random distribution on reel strip 34 which, in operation upon the reel of the slot machine 1, stops to reveal to the gambler a single prize image at the prize window 9, as shown in FIG. 1.

For gambling slot machines 1, new reel strips 34 are used. FIG. 2D shows a perspective view of the parallel co-axial arrangement of three reels 30 having strips 34 thereon. Hub 31 is used in co-axial mounting each of the reels 30 to their independent rotation mechanism within gambling slot machine 1, so that symbols 32 and/or 33 are displayed within media display prize window 9 of slot machine 1.

The reel strips 34 with gaming images 32 and 33 are wound around the periphery of reels 30. The logo 33 is randomly interspersed with traditional jackpot and/or pay off symbols 32 on these strips 34.

In an alternate embodiment of the present invention, a player who gambles a predetermined amount of money in a given slot machine 1 of the present invention earns a number of merchandise points and/or complimentary "comp" coupons exchangeable for commercial or promotional merchandise associated with the advertising logos 2 placed on machine 1 and on strips 34 in the form of indicia 33.

FIG. 2C shows a schematic representation of graphical data on a computer diskette 40. Diskette 40 is used for yet another alternate embodiment which is a video-display type slot machine gambling device.

In the aforesaid video display embodiment, diskette 40 stands for and symbolizes any machine or computer-storable non-volatile memory means, such as, for example but without limitation, a computer hard disk drive, a computer tape, a computer-readable CD-ROM disk, and the like.

In FIG. 2C the image of diskette 40 symbolizes a file of digital data which is or can be displayed on a display screen in the video display embodiment of the present invention. The video display embodiment has a video display corresponding to prize window 9 shown in FIG. 1, wherein the video display embodiment of the present invention comprises an electronic video-type slot machine.

In the video display embodiment, any gaming media corresponding to symbols 32 and 33 of FIGS. 2B and 2D can be utilized corresponding with the use in strip 34 shown in FIG. 2B, as long as the logo image corresponding to commercial indicia symbol 33 in FIG. 2B is substituted for the jackpot and/or pay off image corresponding to symbol 32 in FIG. 2B, normally used in slot machine 1.

In yet another embodiment of the present invention, in FIG. 2A, a new reel 50 is shown having a plurality of jackpot and/or pay off prize cards 52 and advertising logo cards 53 substituted for and corresponding to jackpot and/or pay off and logo symbol indicia 32 and 33.

Figure 3:
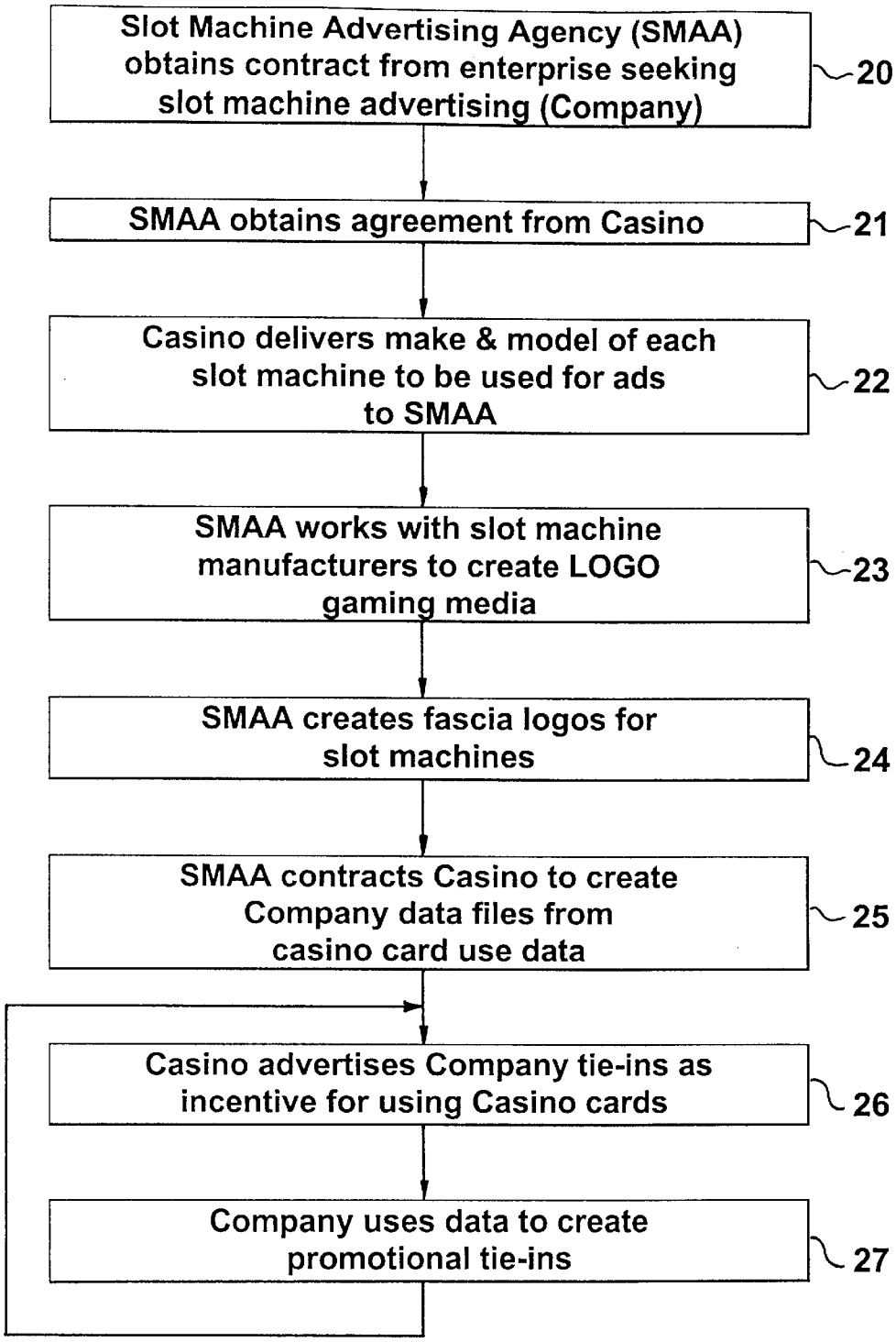

In connection with an alternate embodiment shown in FIG. 3 for a method associated with an improved slot machine wherein a user's accumulated bonus points are redeemable for commercial, promotional or advertising merchandise, the club card slot 11 in the upper right corner is used by players who are casino members. The card slot 11 is used when a user card, which is machine-readable and encodable with user gambling information, is inserted therein.

Since casinos often offer discounts, complimentary coupons called "comps" and other incentives for casino members; casino members' accounts are tracked by the casino by use of data collected from member cards having encoded, machine readable gambling information data, which is collected in computer files, and is accumulated from and based upon actual user gambling play.

FIG. 3 shows a flow chart of the necessary steps in using this advertising method. In the process described, a slot machine advertising agency first obtains a contract from a company seeking to advertise a product or logo by this method step 20. The slot machine advertising agency then contacts one or more casinos in method step 21 to obtain agreements.

The casino earns advertising revenue from the paid advertisements. The casino gives the slot machine advertising agency the make and model of each machine to be used for the advertising in method step 22. The slot machine advertising agency works with various graphic companies to create the appropriate gaming media for the machines, substituting, in method step 23, company logos corresponding to symbols 33 in FIG. 2B for those shown in for the jackpot and/or pay off symbols 32 shown in FIG. 2B.

Similarly, in method step 24, fascia advertising is created and is placed onto slot machine 1. Once method steps 23 and 24 have been done for a particular company advertising client for particular slot machines 1, it is convenient and inexpensive to replicate the advertising for more such machines. The slot machine advertising agency gains an agreement from the casino to track activity on the advertising machines via data collection relative to the use of casino cards according to method step 25. This data is of interest to the company. The casino can advertise the fact that the company has incentive tie-ins keyed to the use of a casino card, according to method step 26.

For example, Brand X Example Product may be associated with a catalog of logo products called, for an example "GEAR". If Brand X Example Product were to advertise in this manner, Brand X Example Product offers bonus points to slot machine players. The players are identified by both Brand X and by the casino by means of the gamblers' use of the casino card.

Therefore, an advertiser, such as Brand X Example Product uses the data gathered from gamblers' casino cards to form a database to track the effectiveness of slot machine advertising and to help create appropriate promotional tie-ins, according to method step 27.

The more desirable the promotional company tie-ins, the greater the incentive for players to become casino members and use their casino card to play, as shown in the interactive loop shown in the method steps depicted in diagram blocks 26 and 27 of FIG. 3.

The exact same procedure is established for video games, except that the entire program is introduced on a computer chip, as all video games are computerized.

It is further known that other modifications may be made to the present invention, in accordance with the scope of the claims, as appended herein.

I claim:

1. A gambling device for displaying commercial advertising indicia in an authorized commercially sustainable manner, comprising:

a. a random variety of gaming symbols arranged according to the gambling game, the gaming symbols comprising advertising indicia from an advertiser in said gambling device;

b. first means for initiating play of said gambling game in said gambling device comprises a slot for insertion of cash; and c. second means for initiating play of said gambling game in said gambling device comprising a card slot and a gambling casino card, said slot being for user insertion of said gambling casino card for encoding machine-readable gambling user information and storing machine readable gambling data relative only to the card user's gambling activity associated only with said gambling devices displaying said advertising for use in obtaining awards and incentives from said advertiser.

2. The device of claim 1 further having non-gaming fascias, the fascias bearing authorized commercially sustainable advertising indicia displayed thereon.

3. The device of claim 2 where the device comprises at least one prize symbol display means, the display means further comprising a plurality of randomly displayable graphic images, the images comprising authorized commercially sustainable advertising indicia.

4. The device of claim 3 wherein the prize symbol display means comprises a mechanical gambling device having at least one circular reel bearing randomly displayable graphic images, the images comprising authorized commercially sustainable advertising indicia.

5. The device of claim 4, having a plurality of independently rotatable reels for independent random display of the randomly displayable graphic images.

6. The device of claim 4, having a plurality of independently displayable video images for independent random display of the randomly displayable graphic images.

7. The device of claim 3 wherein the prize symbol display means comprises an electronic video display gambling device having at least one display field bearing randomly displayable graphic images, the images comprising authorized commercially sustainable advertising indicia.

8. The device of claim 3 where all randomly displayable graphic images comprise authorized commercially sustainable advertising indicia.

9. The device of claim 3 where some randomly displayable graphic images comprise authorized commercially sustainable advertising indicia and some randomly displayable graphic images comprise non-advertising indicia.

10. The device of claim 3, wherein the device is a slot machine.

11. The device of claim 10, further comprising a reel covering strip installed upon the at least one reel, where the gaming display symbols are printed in random distribution on the reel strip which, in operation upon the reel of the slot machine, stops to reveal to the gambler a single prize image.

12. The device of claim 10 further having a plurality of reels, mounted in co-axial independently rotatable relationship so that randomly displayable graphic images symbols are independently displayed upon each independently rotatable reel.

13. The device of claim 3, wherein the insertion of a predetermined amount of money in a given device causes the accumulation of credits translatable into user winnable merchandise points exchangeable for commercial or promotional merchandise associated with the authorized commercially sustainable advertising indicia.

14. A method of enhancing the pleasurable experience of casino gamblers, comprising the steps of:

a. obtaining a commercial relationship between a gambling casino and an advertiser which relationship provides for authorized advertising indicia to be installed in casino gambling devices for playing gambling games;

b. modifying said casino gambling devices in accordance with the terms of said relationship so that said gambling devices bear said advertising indicia as gaming symbols used in playing said gambling games;

c. providing for gamblers to have and to use casino gambling cards, the cards encoding and storing machine readable gambling data relative only to the card-user's gambling activity associated only with said gambling devices displaying said advertizing indicia;

d. tracking gambler activity electronically via data collection on said cards relative only to the use of said casino gambling cards in association with only said gambling devices displaying said advertising indicia; and e. linking the gambling data collected electronically on said cards to said advertising indicia and distribution of promotional and merchandise give-away incentives to gamblers to enhance and maintain gambling activity.

15. The method of claim 14 in which said gaming symbols consist of advertising indicia from multiple advertisers.

* * * * *